United States Patent [19]

Radwanski et al.

[11] Patent Number: 4,879,170

[45] Date of Patent: Nov. 7, 1989

[54] NONWOVEN FIBROUS HYDRAULICALLY ENTANGLED ELASTIC COFORM MATERIAL AND METHOD OF FORMATION THEREOF

[75] Inventors: Fred R. Radwanski, Norcross, Ga.; Lloyd E. Trimble, Dustin, Okla.; Roland C. Smith, Gainesville; Linda A. Connor, Atlanta, both of Ga.

[73] Assignee: Kimberly-Clark Corporation, Neenah, Wis.

[21] Appl. No.: 170,196

[22] Filed: Mar. 18, 1988

[51] Int. Cl.[4] ..... B32B 1/04

[52] U.S. Cl. ..... 428/233; 28/104; 28/105; 428/236; 428/237; 428/240; 428/283; 428/284; 428/286; 428/287; 428/288; 428/296; 428/299; 428/301

[58] Field of Search ..... 428/284, 286, 287, 288, 428/296, 299, 301, 233, 236, 237, 240, 283; 28/104, 105; 424/421, 422

[56] References Cited

U.S. PATENT DOCUMENTS

| | | | |
|---|---|---|---|
| 3,485,706 | 12/1969 | Evans | 161/72 |
| 3,493,462 | 2/1970 | Bunting et al. | 161/169 |
| 3,494,821 | 2/1970 | Evans | 161/169 |
| 3,498,874 | 3/1970 | Evans | 161/109 |
| 3,508,308 | 4/1970 | Bunting et al. | 28/72.2 |
| 3,563,241 | 2/1971 | Evans | 128/284 |
| 3,620,903 | 1/1970 | Bunting et al. | 161/169 |
| 3,741,724 | 6/1973 | Harmon | 8/115.5 |
| 4,100,324 | 6/1978 | Anderson et al. | 428/288 |
| 4,118,531 | 10/1978 | Hauser | 428/224 |
| 4,209,563 | 6/1980 | Sisson | 428/288 |
| 4,426,420 | 1/1984 | Likhyani | 428/224 |
| 4,426,421 | 1/1984 | Nakamae et al. | 428/234 |
| 4,442,161 | 4/1984 | Kirayoglu | 428/219 |
| 4,532,173 | 7/1985 | Suzuki et al. | 428/218 |
| 4,591,513 | 5/1986 | Suzuki et al. | 427/200 |
| 4,775,579 | 10/1988 | Hagy et al. | 428/284 |
| 4,808,467 | 2/1989 | Suskind et al. | 428/284 |

FOREIGN PATENT DOCUMENTS

| | | | |
|---|---|---|---|
| 841938 | 5/1970 | Canada | 92/11 |
| 108621 | 5/1984 | European Pat. Off. . | |
| 128667 | 12/1984 | European Pat. Off. . | |
| 1367944 | 9/1974 | United Kingdom . | |
| 1544165 | 4/1979 | United Kingdom . | |
| 1550955 | 8/1979 | United Kingdom . | |
| 2085493 | 4/1982 | United Kingdom . | |
| 2114054 | 8/1983 | United Kingdom . | |
| 2114173 | 8/1983 | United Kingdom . | |

OTHER PUBLICATIONS

"First Weaving, Then Knitting, Now Spunlaced Nonwovens", Nonwovens Industry, Jul. 1987, pp. 32, 34 and 35.

"Water Jet Entangled Nonwovens", John R. Starr, Insight 87, 9-21-87, pp. 1-20.

(List continued on next page.)

*Primary Examiner*—Marion C. McCamish

*Attorney, Agent, or Firm*—Karl V. Sidor

[57] ABSTRACT

Nonwoven fibrous elastomeric web material, including absorbent webs and fabric web material, and methods of forming the same, are disclosed. The elastomeric web material is a hydraulically entangled coform or admixture of (1) meltblown fibers, such as elastic meltblown fibers and (2) pulp fibers and/or staple fibers and/or meltblown fibers and/or continuous filaments, with or without particulate material; such coform can be hydraulically entangled by itself or with other materials, including, e.g., super absorbent particulate material. The use of meltblown fibers facilitates the hydraulic entangling, resulting in a high degree of entanglement and enabling the use of shorter staple or pulp fibers. The hydraulic entangling technique provides a nonwoven fibrous elastic material having increased web strength and integrity, and allows for better control of other product attributes, such as absorbency, wet strength and abrasion resistance. A smooth surfaced and/or highly absorbent elastic web material, with isotropic strength and recovery in both machine- and cross-directions, can be provided according to the present invention.

27 Claims, 3 Drawing Sheets

OTHER PUBLICATIONS

"Spunlaced Products. Technology and End-Use Applications", E. I. du Pont de Nemours & Company Inc., Section XII.

"Suominen Offers Wide Range of Spunlaced Nonwovens", vol. 12, No. 6, European Disposables and Nonwovens Assoc. Newsletter, Nov./Dec. 1986.

"The Perfojet Entanglement Process", Andre Vuillaume, Nonwovens World, Feb. 1987, pp. 81–84.

"Burlington Tries Polyester/Cotton Spunlace", Nonwovens World, May–Jun. 1987, pp. 19 and 21.

"Progress with Sontara and Spunlaced Fabrics in Europe", Nonwovens Report, Jan. 1978, pp. 7 and 8.

"Composite of Synthetic-fiber Web and Paper", Research Disclosure, No. 09196/78, Jun. 1978.

"Inda Looks Into the Future of Nonwovens Fabrics", INDA-TEC Nonwovens Technology Conference, Jun. 2–5, 1986, p. 5.

NONWOVEN FIBROUS HYDRAULICALLY ENTANGLED ELASTIC COFORM MATERIAL AND METHOD OF FORMATION THEREOF

BACKGROUND OF THE INVENTION

The present invention relates to nonwoven fibrous elastic material (e.g., a nonwoven fibrous elastic web), including reinforced elastic material, wherein the nonwoven fibrous elastic material is a hydraulically entangled conform (e.g., admixture) of meltblown fibers and fibrous material (for example, meltblown fibers of an elastomeric material and at least one of (1) pulp fibers, (2) staple fibers, (3) meltblown fibers and (4) continuous filaments), with or without particulate material; nonwoven material including laminates of such nonwoven fibrous elastomeric web attached to a film or fibrous web; and methods of forming such material.

It has been desired to provide a coform which has increased strength and structural integrity, and, depending on the materials utilized, which can be made low linting and highly absorbent, with excellent hand, drape, and anisotropic stretch and recovery properties. It has also been desired to provide such coform, which can be produced relatively inexpensively. Such coform would have wide use in a range of applications, including wipes, absorbent inserts and outer covers for diapers, feminine napkins and incontinence articles, bibs, bed mattress pads, terry cloth and various durables, including garments.

U.S. Pat. No. 4,100,324 to Anderson, et al., the contents of which are incorporated herein by reference, discloses a nonwoven fabric-like composite material which consists essentially of an air-formed matrix of thermoplastic polymer microfibers having an average fiber diameter of less than about 10 microns, and a multiplicity of individualized wood pulp fibers disposed throughout the matrix of microfibers and engaging at least some of the microfibers to space the microfibers apart from each other. This patent discloses that the wood pulp fibers can be intertwined by and held captive within the matrix of microfibers by mechanical entanglement of the microfibers with the wood pulp fibers achieved during incorporation and deposition of the wood pulp fibers and meltblown fibers; and that the mechanical entanglement and intertwining of the microfibers and wood pulp fibers alone, without additional bonding such as adhesive bonding, thermal bonding, additional mechanical bonding, etc., forms a coherent integrated fibrous structure. This patent further discloses that the strength of the web can be improved by embossing the web either ultrasonically or at an elevated temperature so that the thermoplastic microfibers are flattened into a film-like structure in the embossed areas. Additional fibrous and/or particulate materials, including synthetic fibers such as staple nylon fibers and natural fibers such as cotton, flax, jute and silk can be incorporated in the composite material. The material is formed by initially forming a primary air stream containing meltblown microfibers, forming a secondary air stream containing wood pulp fibers (or wood pulp fibers and other fibers; or wood pulp fibers and/or other fibers, and particulate material), merging the primary and secondary streams under turbulent conditions to form an integrated air stream containing a thorough mixture of the microfibers and added fibers, such as wood pulp fibers, etc., and then directing the integrated air stream onto a forming surface to air-form the fabric-like material. A wide variety of thermoplastic polymers are disclosed in Anderson, et al. as being useful for forming the meltblown microfibers, such materials including polypropylene and polyethylene, polyamides, polyesters such as polyethylene eerephthalate and thermoplastic elastomers such as polyurethanes. This patent discloses that by appropriate selection of thermoplastic polymers, materials with different physical properties can be fashioned. However, the product produced by Anderson, et al., particularly when further bonded, lacks the tactile and visual aesthetics necessary for textile materials.

U.S. Pat. No. 4,118,531 to Hauser discloses fibrous webs, and methods of forming such webs, the webs including microfibers and crimped bulking fibers. This patent discloses that the webs are formed by forming the microfibers by a meltblowing technique, admixing the crimped bulking fibers with the microfibers, and then depositing the admixture on a collecting surface. This patent discloses that the fibrous webs are resilient and have good heat insulation properties.

U.S. Pat. No. 3,485,706 to Evans discloses a textile-like nonwoven fabric and a process and apparatus for its production, wherein the fabric has fibers randomly entangled with each other in a repeating pattern of localized entangled regions interconnected by fibers extending between adjacent entangled regions. The process disclosed in this patent involves supporting a layer of fibrous material on an apertured patterning member for treatment, jetting liquid supplied at pressures of at least 200 pounds per square inch (psi) gage to form streams having over 23,000 energy flux in foot-pounds/inch$^2$.second at the treatment distance, and traversing the supporting layer of fibrous material with the streams to entangle fibers in a pattern determined by the supporting member, using a sufficient amount of treatment to produce uniformly patterned fabric. (Such technique, of using jetting liquid streams to entangle fibers in forming a bonded web material, is herein called hydraulic entanglement.) The initial material is disclosed to consist of any web, mat, batt or the like of loose fibers disposed in random relationship with one another or in any degree of alignment. The initial material may be made by desired techniques such as by carding, random lay-down, air or slurry deposition, etc.; and may consist of blends of fibers of different types and/or sizes, and may include scrim, woven cloth, bonded nonwoven fabrics, or other reinforcing material, which is incorporated into the final product by the hydraulic entanglement. This patent discloses the use of various fibers, including elastic fibers, to be used in the hydraulic entangling. In Example 56 of this patent is illustrated the preparation of nonwoven, multi-level patterned structures composed of two webs of polyester staple fibers which have a web of spandex yarn located therebetween, the webs being joined to each other by application of hydraulic jets of water which entangle the fibers of one web with the fibers of an adjacent web, with the spandex yarn being stretched 200% during the entangling step, thereby providing a puckered fabric with high elasticity in the warp direction.

U.S. Pat. No. 3,494,821 to Evans discloses nonwoven fabrics of staple fibers highly entangled with, for example, continuous filaments or yarns, produced by assembling layers of reinforcing filaments or yarns, and staple-length textile fibers, on a patterning member and hydraulically entangling the fibers by high energy treatment with liquid streams of very small diameter formed at very high pressures.

U.S. Pat. No. 4,426,421 to Nakamae, et al. discloses a multi-layer composite sheet useful as a substrate for artificial leather, comprising at least three fibrous layers, namely, a superficial layer consisting of spun-laid extremely fine fibers entangled with each other, thereby forming a body of a nonwoven fibrous layer; an intermediate layer consisting of synthetic staple fibers entangled with each other to form a body of nonwoven fibrous layer; and a base layer consisting of a woven or knit fabric. The composite sheet is disclosed to be prepared by superimposing the layers together in the aforementioned order and, then, incorporating them together to form a body of composite sheet by means of a needle-punching or water-stream-ejecting under a high pressure. This patent discloses that the spun-laid extremely fine fibers can be produced by the meltblown method.

U.S. Pat. No. 4,209,563 to Sisson discloses a method of making an elastic material, and the elastic material formed by such method, the method including continuously forwarding relatively elastomeric filaments and elongatable but relatively non-elastic filaments onto a forming surface and bonding at least some of the filament crossings to form a coherent cloth which is subsequently mechanically worked, as by stretching, following which it is allowed to relax; the elastic modulus of the cloth is substantially reduced after the stretching resulting in the permanently stretched non-elastic filaments relaxing and looping to increase the bulk and improve the feel of the fabric. Forwarding of the filaments to the forming surface is positively controlled, which the patentee contrasts to the use of air streams to convey the fibers as used in meltblowing operations. Bonding of the filaments to form the coherent cloth may utilize embossing patterns or smooth, heated roll nips.

U.S. Pat. No. 4,426,420 to Likhyani discloses a nonwoven fabric having elastic properties and a process for forming such fabric, wherein a batt composed of at least two types of staple fibers is subjected to a hydraulic entanglement treatment to form a spun laced nonwoven fabric. For the purpose of imparting greater stretch and resilience to the fabric, the process comprises forming the batt of hard fibers and of potentially elastic elastomeric fibers, and after the hydraulic entanglement treatment heat-treating the thus produced fabric to develop elastic characteristics in the elastomeric fibers. The preferred polymer for the elastomeric fibers is poly(butylene terephthalate)-co-poly-(tetramethyleneoxy) terephthalate. The hard fibers may be of any synthetic fiber-forming material, such as polyesters, polyamides, acrylic polymers and copolymers, vinyl polymers, cellulose derivatives, glass, and the like, as well as any natural fibers, such as cotton, wool, silk, paper and the like, or a blend of two or more hard fibers, the hard fibers generally having low stretch characteristics as compared to the stretch characteristics of the elastic fibers. This patent further discloses that the batt of the mixture of fibers that is hydraulically entangled can be formed by the procedures of forming fibers of each of the materials separately, and then blending the fibers together, the blend being formed into a batt on a carding machine.

U.S. Pat. No. 4,591,513 to Suzuki, et al. discloses a fiber-implanted nonwoven fabric, and method of producing such nonwoven fabric, wherein a fibrous web consisting of fibers shorter than 100 mm is laid upon a foamed and elastic sheet of open pore type having a thickness less than 5 mm, with this material then being subjected to hydraulic entangling, while the foamed sheet is stretched by 10% or more, so that the short fibers of the fibrous web may be implanted deeply into the interior of the foamed sheet and not only mutually entangled on the surface of the fibrous web but also interlocked with material of the foamed sheet along the surface as well as in the interior of the foamed sheet. The short fibers can include natural fibers such as silk, cotton and flax, regenerated fibers such as rayon and cupro-ammonium rayon, semi-synthetic fibers such as acetate and premix, and synthetic fibers such as nylon, vinylon, vinylidene, vinyl chloride, polyester, acryl, polyethylene, polypropylene, polyurethane, benzoate and polyclar. The foamed sheet may be of foamed polyurethane.

While the above-discussed documents disclose products and processes which exhibit some of the characteristics or method steps of the present invention, none discloses or suggests the presently claimed process or the product resulting from this process, and none achieves the advantages of the present invention. Thus, the coform web material produced by the process in U.S. Pat. No. 3,100,324 to Anderson, et al., when bonded by further bonding techniques such as adhesives, lacks the aesthetics necessary for the web material to be used advantageously for textile materials. Moreover, the non-woven fabric of U.S. Pat. No. 3,485,706 to Evans uses staple fibers to provide the loose ends necessary for the hydraulic entangling.

Thus, it is desired to provide a nonwoven fibrous elastomeric web material having increased web strength and integrity over known structures. It is further desired to provide a nonwoven fibrous elastomeric web material which is low linting and can be made highly absorbent, which material can have a cloth-like, smooth or textured surface with excellent hand, drape, and isotropic stretch and recovery properties, and barrier properties, depending on the materials utilized in the web, and which material has improved abrasion resistance. It is further desired to provide such material, utilizing a process which is simple and relatively inexpensive.

SUMMARY OF THE INVENTION

Accordingly, it is an object of the present invention to provide a nonwoven fibrous elastomeric material (e.g., a nonwoven fibrous self-supporting elastomeric material, such as a nonwoven elastomeric web) having high web strength and integrity, isotropic strength, and with isotropic stretch and recovery properties, and methods for forming such material.

It is a further object of the present invention to provide a nonwoven fibrous elastomeric web material having high web strength and integrity, low linting and high durability, which material is highly absorbent, and methods of forming such material.

It is a further object of the present invention to provide a nonwoven fibrous elastomeric material that has a cloth-like, smooth or textured surface, with excellent hand, drape and isotropic stretch and recovery properties, which can be used as a fabric for, e.g., durables.

It is a further object of the present invention to provide a nonwoven fibrous elastomeric material having improved tactile and visual aesthetics, for such material to be used for various textile purposes, including garments.

It is a still further object of the present invention to provide a laminate of such nonwoven fibrous elastomeric material and another web, either fibrous or nonfibrous (e.g., a film), having elastic properties. Such laminate can be used in disposable diapers (e.g., the nonwoven fibrous elastomeric material being bonded to a film to provide cotton-like feel to the laminate).

It is a further object of the present invention to provide a reinforced nonwoven fibrous elastomeric web material, wherein the web includes a reinforcing material such as a scrim, screen, net, melt-spun nonwoven, woven material, etc., and methods of forming such reinforced nonwoven fibrous web material.

It is a further object of the present invention wherein staple fibers are not necessary to provide the loose ends necessary for hydraulic entangling.

The present invention achieves each of the above objects by providing a composite nonwoven fibrous elastomeric material formed by hydraulically entangling a coform comprising an admixture of (1) meltblown fibers and (2) fibrous material, with or without particulate material incorporated in the admixture, wherein at least one of the meltblown fibers and fibrous material are elastic so as to provide a product, after hydraulic entangling, that is elastic. Desirably, the meltblown fibers can be made of an elastomeric material, whereby the admixture subjected to hydraulic entanglement is constituted by (1) meltblown elastic fibers (e.g., meltblown fibers of a thermoplastic elastomeric material), and (2) fibrous material (e.g., at least one of pulp fibers, staple fibers, meltblown fibers and continuous filaments).

The fibrous material can be pulp fiber. The fiber material can be any cellulosic material, including, e.g., wood fibers, rayon, cotton, etc.; and the staple fibers can be either natural or synthetic staple fibers, including, e.g., wool fibers and polyester fibers.

The fibrous material can be meltblown fibers. For example, streams of different meltblown fibers can be intermingled just after their formation (e.g., just after extrusion and attenuation of the polymeric material forming the meltblown fibers). The meltblown fibers can be made of different materials and/or have different diameters (e.g., admixtures of meltblown microfibers, or admixtures of meltblown microfibers and meltblown macrofibers, can be subjected to the hydraulic entanglement). Thus, the admixture subjected to hydraulic entanglement can be 100% meltblown fibers. In any event, the coform (admixture) must have sufficient free and mobile fibers to provide the desired degree of entangling and intertwining, i.e., sufficient fibers to wrap around or intertwine and sufficient fibers to be wrapped around or intertwined.

The fibrous material can be continuous filaments. The continuous filaments can be elastomeric, or can be formed into a web with the elastic meltblown fibers and then mechanically worked so that the resulting web has elasticity, as discussed in the previously-referred-to U.S. Pat. No. 4,209,563, the contents of which are incorporated herein by reference. Thus, the continuous filaments can be elastomeric filaments such as, e.g., spandex, or can be elastomeric yarns. Moreover, spunbond continuous filaments, or other continuous filaments or yarns, can be mixed with the meltblown elastic fibers prior to depositing on a collecting surface, with the admixture of meltblown elastic fibers and continuous filaments being hydraulically entangled. Of course, in this latter case if the continuous filaments are non-elastic, they must be elongatable, whereby mechanical working (stretching, as in U.S. Pat. No. 4,209,563) of the material after hydraulic entangling will provide a material having stretch up to a "stopping point" governed by how much the elongatable continuous filaments had been elongated. In this latter case, loose fibers (e.g., staple fibers) can also be included in the admixture that is hydraulically entangled.

In addition, a spunbond web of continuous filaments can be laminated with a meltblown elastomeric coform web, and the laminate then hydraulically entangled. Here also, as in previous embodiments, where the continuous filaments are non-elastic the hydraulically entangled material must be subjected to mechanical working in order to form an elastic material. Generally, an admixture of meltblown elastic fibers and loose (staple or pulp) fibers can be laminated to another web and then hydraulically entangled, with the resulting material mechanically worked, if necessary, as discussed above to form an elastic material within the scope of the present invention.

The use of meltblown fibers as part of the admixture subjected to hydraulic entangling facilitates entangling. This results in a higher degree of entanglement and allows the use of shorter staple or pulp fibers.

Moreover, the use of a coform including meltblown fibers decreases the amount of energy needed to achieve satisfactory hydraulic entangling, as compared to the amount of energy necessary to, e.g., hydraulically entangle together separate layers laminated one on the other, with at least one of the layers being elastic fibers. As can be appreciated, a decreased amount of energy is required to hydraulically entangle an intimate blend, as compared to the amount of energy needed to hydraulically entangle a laminate to provide an intimate blend.

The use of meltblown fibers provides an improved product in that the entangling and intertwining among the meltblown fibers and pulp fibers and/or staple fibers is improved. Due to the relatively great length and relatively small thickness of the meltblown fibers, wrapping of the individual meltblown fibers around and within other fibers and filaments in the web is enhanced. Moreover, the meltblown fibers have a relatively high surface area, small diameters and are a sufficient distance apart from one another to, e.g., allow cellulose fibers to freely move and wrap around and within the meltblown fibers.

Furthermore, due to the relatively long length of the meltblown elastic fibers, the product formed by hydraulically entangling fibers including such meltblown fibers have better recovery; that is, slippage between entangled bonded fibers would be expected to be less than when, e.g., 100% staple elastic fibers are used.

In addition, by utilizing a coform of (1) the meltblown fibers and (2) staple fibers and/or pulp fibers and/or meltblown fibers and/or continuous filaments, together with any other materials incorporated therewith (e.g., particulates), better blending of the various fibers and particulates are achieved.

Moreover, use of meltblown fibers, as part of a coform web that is hydraulically entangled, has the added benefit that, prior to hydraulic entanglement, the web has some degree of entanglement and integrity.

The use of hydraulic entangling techniques, to mechanically entangle (e.g., mechanically bond) the fibrous material, rather than using only other bonding techniques, including other mechanical entangling techniques such as needle punching, provides a composite nonwoven fibrous web material having increased strength and integrity, with isotropic strength properties, while not deteriorating hand, drape and isotropic stretch and recovery properties, and allows for better control of other product attributes, such as absorbency, wet strength, abrasion resistance, visual and tactile aesthetics, etc. In addition, use of hydraulic entangling adds liveliness to the resulting elastic material that is not achieved when using, e.g., thermal or chemical bonding techniques. That is, the combination of elastic and drape properties achieved by the present invention provides a liveliness in the final product not achieved when using other bonding techniques. Moreover, use of hydraulic entangling easily permits dissimilar fibrous materials (e.g., materials that cannot be chemically or thermally bonded) to be used.

Moreover, depending on the various fibrous material (e.g., pulp and/or staple fibers and/or meltblown fibers and/or continuous filaments) utilized together with the meltblown elastic fibers in the coform that is hydraulically entangled, a final product having a cloth-like, smooth surface can be achieved, and/or a product that is highly absorbent and low linting can be achieved. Such product has excellent abrasion resistance. Such product can have excellent stretch and recovery (a deficiency of conventional hydraulically entangled products), without a rubbery feeling of the product (that is, the product can have a cotton-like feel). In particular, utilizing, e.g., staple fibers as part of the coform, together with the meltblown elastic material, a fabric that is isotropic (that is, in both the machine direction and cross direction) in both stretch and recovery properties, having a cloth-like smooth surface, can be achieved. Such material could have many uses, ranging from disposable outer covers to durable fabrics for clothing and home furnishings. For example, in view of the excellent drape of the entangled product, an ultra suede product can be provided by the present invention. In addition, the present invention can be utilized to form insulation material having stretch properties, such as mattress pads.

Moreover, by incorporating, e.g., a cellulosic, pulp material fiber with the meltblown elastic material, and hydraulically entangling the admixture of pulp and meltblown elastic fibers, a highly absorbent, low linting material, having exceptionally good structural integrity, can be achieved. Moreover, such composite could be made water repellent and used as ah outer cover or garment.

DETAILED DESCRIPTION OF THE INVENTION

Figure 1:
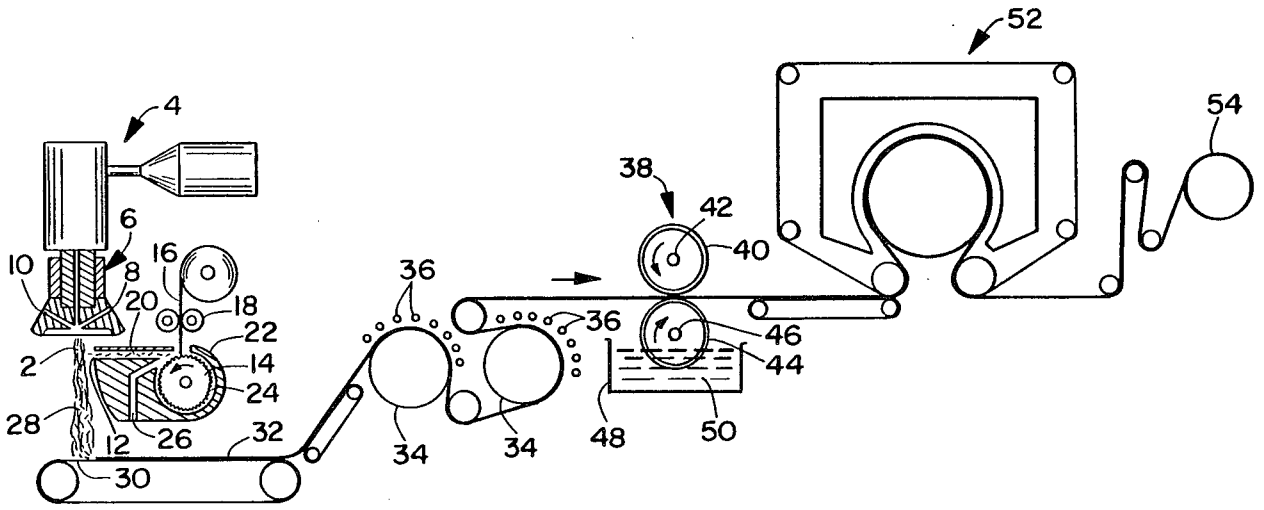
FIG. 1 is a schematic view of one example of an apparatus for forming a nonwoven hydraulically entangled coform elastic web material of the present invention.

While the invention will be described in connection with specific and preferred embodiments, it will be understood that it is not intended to limit the invention to those embodiments. On the contrary, it is intended to cover all alterations, modifications and equivalents as may be included within the spirit and scope of the invention as defined by the appended claims.

The present invention contemplates a nonwoven fibrous hydraulically entangled coform elastic material and a method of forming the same. The invention involves the processing of a coform or admixture of meltblown fibers and fibrous material, with or without particulate material, with either the meltblown fibers or fibrous material being elastomeric, and with the meltblown fibers and fibrous material being either alone in the admixture or being with other materials, including particulate material, and either as a single coform layer or plurality of stacked layers. The admixture is hydraulically entangled, that is, a plurality of high pressure liquid columnar streams are jetted toward a surface of the admixture, thereby mechanically entangling and intertwining the meltblown fibers and the fibrous material fibers so as to form the elastic material. The fibrous material can be at least one of pulp fibers, staple fibers meltblown fibers and continuous filaments.

By a coform of meltblown fibers and fibrous material, we mean an admixture (e.g., codeposited admixture) of meltblown fibers and the fibrous material. Desirably, the fibrous material is intermingled with the meltblown fibers just after extruding the material of the meltblown fibers through the meltblowing die, as discussed in U.S. Pat. No. 4,100,324, previously incorporated herein by reference. Where the admixture includes pulp fibers and/or staple fibers and/or continuous filaments in addition to meltblown fibers, with or without particulate material, the admixture may contain 1% to 99% by weight meltblown fibers. Of course, where the fibrous material is meltblown fibers, the admixture may be 100% meltblown fibers. By codepositing the meltblown fibers and the fibrous material in this manner, a substantially homogeneous admixture is deposited to be subjected to the hydraulic entanglement. Various other techniques can be utilized to provide the coform. For example, fibers can be dry laid or wet laid (by conventional techniques) into a web of meltblown fibers, in order to form the admixture. As a specific embodiment, a meltblown web can be stretched, with fibers being wet laid into the stretched web to form the admixture. Generally, mixtures of meltblown fibers and fibrous material, which after hydraulic entanglement form an elastic material, can be used as the coforms (admixtures) for purposes of the present invention.

It is not necessary that the coform web (e.g., the meltblown fibers of the coform) be totally unbonded when passed into the hydraulic entangling step. However, the main criterion is that, during the hydraulic entangling, there are sufficient free fibers (the fibers are sufficiently mobile) to provide the desired degree of entangling. Thus, if the meltblown fibers have not been agglomerated too much in the meltblowing process, such sufficient mobility can possibly be provided by debonding a lightly bonded web due to the force of the jets during the hydraulic entangling. In this regard, the degree of agglomeration of the deposited admixture, including the meltblown fibers, is affected by the processing parameters in forming and depositing the meltblown fibers, e.g., extruding temperature, attenuation air temperature, quench air or water temperature, forming distance, etc. An advantageous technique to avoid undue agglomeration of the deposited admixture that is subjected to the hydraulic entangling is to quench the formed fibers prior to deposition on a collecting surface. A quenching technique is disclosed in U.S. Pat. No. 3,959,421 to Weber, et al., the contents of which are incorporated herein by reference.

Alternatively, the coform web can be treated prior to the hydraulic entangling to sufficiently unbond the fibers. For example, the coform web can be, e.g., mechanically stretched and worked (manipulated), e.g., by using grooved nips or protuberances, prior to hydraulic entangling to sufficiently unbond the fibers.

The terms "elastic" and "elastomeric" are used interchangeably herein to mean any material which, upon application of a force, is stretchable to a stretched length which is at least about 110% of its relaxed length, and which will recover at least about 40% of its elongation upon release of the stretching, elongating force. For many uses (e.g., garment purposes), a large amount of elongation (e.g., over 12%) is not necessary, and the important criterion is the recovery property. Many elastic materials may be stretched by much more than 25% of their relaxed length and many of these will recover to substantially their original relaxed length upon release of the stretching, elongating force.

As used herein, the term "recover" refers to a contraction of a stretched material upon termination of a force following stretching of the material by application of the force. For example, if a material having a relaxed, unbiased length of one (1) inch was elongated 50% by stretching to a length of 1 and ½ (1.5) inches the material would have a stretched length that is 150% of its relaxed length. If this exemplary stretched material contracted, that is recovered, to a length of 1 and 1/10 (1.1) inches, after release of the biasing and stretching force, the material would have recovered 80% (0.4 inch) of its elongation.

As used herein, the term "meltblown fibers" refers to fibers which are made by extruding a molten thermoplastic material through a plurality of fine, usually circular, die capillaries as molten threads or filaments into a high velocity gas (e.g., air) stream which attenuates the filaments of molten thermoplastic material to reduce their diameter. Thereafter, the meltblown fibers are carried by the high velocity gas stream and are deposited on a collecting surface to form a web of randomly dispersed meltblown fibers. Meltblown fibers within the scope of the present invention include both microfibers (fibers having a diameter, e.g., of less than about 10 microns) and macrofibers (fibers having a diameters, e.g., of about 20–100 microns, particularly 20–50). Whether microfibers or macrofibers are formed depend, e.g., on the extrusion die size and, particularly, the degree of attenuation of the extruded polymer material. Meltblown macrofibers, as compared to meltblown microfibers, are firmer, and provide a product having a higher bulk. Generally, meltblown elastic fibers have relatively large diameters, and do not fall within the microfiber size range. Processes for forming meltblown fibers and depositing such fibers on a collecting surface are disclosed, for example, in U.S. Pat. No. 3,849,241 to Buntin, et al. and U.S. Pat. No. 4,048,364 to Harding, et al., the contents of each of which are herein incorporated by reference.

It is preferred that conventional meltblowing techniques be modified, as set forth below, in providing the most advantageous elastic meltblown coform webs to be hydraulically entangled. As indicated previously, fiber mobility is highly important to the hydraulic entangling process. For example, not only do the "wrapper" fibers have to be flexible and mobile, but in many instances the base fibers (around which the other fibers are wrapped) also need to move freely. However, an inherent property of elastic meltblowns is agglomeration of the fibers; that is, the fibers tend to stick together or bundle as a result of their tackiness. Accordingly, it is preferred, in forming the meltblown web, to take steps to limit the fiber-to-fiber bonding of the meltblown web prior to hydraulic entanglement. Techniques for reducing the degree of fiber-to-fiber bonding include increasing the forming distance (the distance between the die and the collecting surface), reducing the primary air pressure or temperature, reducing the forming (under wire) vacuum and introducing a rapid quench agent such as water to the stream of meltblown fibers between the die and collecting surface (such introduction of a rapid quench agent is described in U.S. Pat. No. 3,959,421 to Weber, et al., the contents of which have previously been incorporated herein by reference). A combination of these techniques allows formation of the most advantageous meltblown web for hydraulic entangling, with sufficient fiber mobility and reduced fiber bundle size.

A specific example will now be described, using "Arnitel", a polyetherester elastomeric material available from A. Schulman, Inc. Akzo Plastics, as the elastomeric material formed into meltblown webs to be hydraulically entangled. Thus, conventional parameters for forming meltblown "Arnitel" webs, to provide meltblown "Arnitel" webs to be hydraulically entangled, were changed as follows: (1) the primary air temperature was reduced; (2) the forming distance was increased; (3) the forming vacuum was reduced; and (4) a water quench system was added. Moreover, a forming drum, rather than a flat forming wire, was used for fiber collection, with the fibers being collected at a point tangential to the drum surface.

Essentially, the above-cited changes resulted in rapid fiber quenching thereby reducing the degree of fiber-to-fiber bonding and the size of fiber bundles. The velocity of the fiber stream, as it was collected in web form, was reduced along with impact pressure resulting in the formation of a loosely packed non-agglomerated fiber assembly, which could advantageously be hydraulically entangled.

Various known thermoplastic elastomeric materials can be utilized for forming the meltblown elastomeric fibers; some are disclosed in U.S. Pat. No. 4,657,802 to Morman, the contents of which are incorporated herein by reference. Briefly, this patent discloses various elastomeric materials for use in formation of, e.g., nonwoven elastomeric webs of meltblown fibers, including polyester elastomeric materials, polyurethane elastomeric materials, polyetherester elastomeric materials and polyamide elastomeric materials. Other elastomeric materials for use in the formation of the fibrous nonwoven elastic web include elastomeric polyolefin materials (e.g., thermoplastic polyolefin rubbers, including polypropylene rubbers) elastomeric copolyester materials, and ethylene vinyl acetate. Further elastomeric materials for use in the present invention include (a) A-B-A′ block copolymers, where A and A′ are each a thermoplastic polymer end block which includes a styrenic moiety and where A may be the same thermoplastic polymer end block as A', such as a poly(vinyl arene), and where B is an elastomeric polymer mid block such as a conjugated diene or a lower alkene; or (b) blends of one or more polyolefins or poly-(alpha-methylstyrene) with A-B-A' block copolymers, where A and A' are each a thermoplastic polymer end block which includes a styrenic moiety, where A may be the same thermoplastic polymer end block as A', such as a poly(vinyl arene) and where B is an elastomeric polymer mid block such as a conjugated diene or a lower alkene. Various specific materials for forming the meltblown elastomeric fibers include polyester elastomeric materials available under the trade designation "Hytrel" from E. I. DuPont De Nemours & Co., polyurethane elastomeric materials available under the trade designation "Estane" from B. F. Goodrich & Co., polyetherester elastomeric materials available under the trade designation "Arnitel" from A. Schulman, Inc. or Akzo Plastics, and polyamide elastomeric materials available under the trade designation "Pebax" from the Rilsan Company. Various elastomeric A-B-A' block copolymer materials are disclosed in U.S. Pat. Nos. 4,323,534 to Des Marais and 4,355,425 to Jones, and are available as "Kraton" polymers from the Shell Chemical Company.

When utilizing various of the "Kraton" materials (e.g., "Kraton" G), it is preferred to blend a polyolefin therewith, in order to improve meltblowing of such block copolymers; a particularly preferred polyolefin for blending with the "Kraton" G block copolymers is polyethylene, a preferred polyethylene being Petrothene Na601 obtained from U.S.I. Chemicals Company. Discussion of various "Kraton" blends for meltblowing purposes are described in U.S. Pat. No. 4,657,802, previously incorporated by reference, and reference is directed thereto for purposes of such "Kraton" blends.

Various pulp and staple fibers which can be codeposited with the meltblown elastomeric fibers, to provide the coform which is subjected to hydraulic entangling, are described in U.S. Pat. No. 4,100,324 to Anderson, et al., which previously has been incorporated herein by reference. In general, fibrous material (e.g., pulp fiber and/or stable fiber and/or meltblown fibers and/or continuous filaments), with or without particulate material, can be admixed with meltblown fibers within the context of the present invention. However, sufficiently long and flexible fibers are more useful for the present invention since they are more useful for entangling and intertwining. Southern pine is an example of a pulp fiber which is sufficiently long and flexible for entanglement. Other pulp fibers include red cedar, hemlock and black spruce. For example, a type Croften ECH kraft wood pulp (70% Western red cedar/30% hemlock) can be used. Moreover, a bleached Northern softwood kraft pulp known as Terrace Bay Long Lac-19, having an average length of 2.6 mm, is also advantageous. A particularly preferred pulp material is IPSS (International Paper Super Soft). Such pulp is preferred because it is an easily fiberizable pulp material. However, the type and size of pulp fibers are not particularly limited due to the unique advantages gained by using high surface area meltblown fibers in the present invention. For example, short fibers such as eucalyptus, other such hardwoods and highly refined fibers, e.g., wood fibers and second-cut cotton, can be used since the meltblown fibers are sufficiently small and encase and trap smaller fibers. Moreover, the use of meltblown fibers provide the advantage that material having properties associated with the use of small denier fibers (e.g., 1.35 denier or less) can be achieved using larger denier fibers; use of such larger denier staple fibers is cost effective. Vegetable fibers such as abaca, flax and milkweed can also be used.

Staple fiber materials (both natural and synthetic) include rayon, polyester staple fibers including, e.g., polyethylene terephthalate, cotton (including cotton linters), wool, nylon and polypropylene.

Continuous filaments include filaments, e.g., 20$\mu$ or larger, such as spunbond (spunbond polyolefin such as spunbond polypropylene or polyethylene), bicomponent filaments, shaped filaments, yarns, etc. Nylon or rayon are other materials which can be used for the continuous filaments. The continuous filaments can be included in the admixture for various purposes, including for reinforcement.

Advantageously, spunbond polyolefin continuous filaments are co-deposited with the meltblown fibers to form the admixture, which admixture is then subjected to the hydraulic entangling. Such continuous filaments can be formed concurrently with the forming of the meltblown fibers and mixed therewith prior to deposition of the meltblown fibers on a collecting surface; conventional filament forming apparatus, such as (1) a Lurgi gun or (2) the apparatus described in U.S. Pat. No. 4,340,563 to Appel, et al., the contents of which are incorporated herein by reference, can be used to form the spunbond filaments.

Where continuous filaments are used, either filaments of an elastic material (or a material that can be made elastic by a further treatment) or of an elongatable (but not elastic) material can be used in order to achieve a final product that is elastic. Moreover, where an elongatable (but not elastic) material is used, the hydraulically entangled material will have to be subjected to a post treatment in order to elongate the elongatable material. For example, after the hydraulic entanglement the material can be mechanically worked, e.g., stretched, in at least one direction to elongate the elongatable material, whereby after relaxation of the stretching the worked product will have a low modulus of elasticity in the direction (or directions) of the stretch. A technique of mechanical working to provide elasticity to a bonded product, which corresponds to the present technique, is disclosed in U.S. Pat. No. 4,209,563, previously incorporated herein by reference.

The fibrous material can also include meltblown fibers, which may be microfibers and/or macrofibers. While meltblown fibers, in general, can be used for the fibrous material, it is a requirement that the meltblown fibers forming the fibrous material, and the first-named meltblown fibers, have sufficient fiber mobility such that the mobile fibers can wrap around and within less mobile fibers, to intertwine and intertangle therewith. Thus, while meltblown fibers only of relatively small diameter can be used, at least a portion of the meltblown fibers must be relatively mobile. Of course, a mixture of microfibers and macrofibers can be used to form the admixture, where the macrofibers are relatively less mobile and the microfibers relatively mobile, to provide the necessary entangling and intertwining in the hydraulic entanglement.

At least one of meltblown fibers and fibrous material is elastic, in order that the hydraulically entangled material is elastic.

The various polymers referred to herein include not only the homopolymers, but also copolymers thereof.

FIG. 1 schematically shows a representative apparatus for producing a nonwoven hydraulically entangled elastic coform material within the scope of the present invention. Of course, such apparatus, and the product formed, are merely illustrative and not limiting.

A primary gas stream 2 of, e.g., elastic meltblown microfibers is formed by known meltblowing techniques on conventional meltblowing apparatus generally designated by reference numeral 4, e.g., as discussed in U.S. Pat. No. 3,849,241 to Buntin, et al. and U.S. Pat. No. 4,048,364 to Harding, et al., the contents of each of which has been incorporated herein by reference. Basically, the method of formation involves extruding a molten polymeric material through a die head generally designated by the reference numeral 6 into fine streams and attenuating the streams by converging flows of high velocity, heated gas (usually air) supplied from nozzles 8 and 10 to break the polymer streams into fibers of relatively small diameter. The die head preferably includes at least one straight row of extrusion apertures.

In the present illustrative example, the primary gas stream 2 is merged with a secondary gas stream 12 containing at least one of pulp fibers, staple fibers, meltblown fibers and continuous filaments, with or without particulate material. As indicated previously, long, flexible fibers are more useful for the present invention since they are more useful for entangling and intertwining. Various specific materials for the pulp fibers, staple fibers and continuous filaments have previously been set forth.

The secondary gas stream 12 of, e.g., pulp or staple fibers is produced by a conventional picker roll 14 having picking teeth for divellicating pulp sheets 16 into individual fibers. In FIG. 1, the pulp sheets 16 are fed radially, i.e., along a picker roll radius, to the picker roll 14 by means of rolls 18. As the teeth on the picker roll 14 divellicate the pulp sheets 16 into individual fibers, the resulting separated fibers are conveyed downwardly toward the primary air stream 2 through a forming nozzle or duct 20. A housing 22 encloses the picker roll 14 and provides passage 24 between the housing 22 and the picker roll surface. Process air is supplied by conventional means, e.g., a blower, to the picker roll 14 in the passage 24 via duct 26 in sufficient quantity to serve as a medium for conveying fibers through the duct 26 at a velocity approaching that of the picker teeth.

Staple fibers can be carded and also readily delivered as a web to the picker roll 14 and thus delivered randomly in the formed web. This allows use of higher line speeds and provides a web having isotropic strength properties.

Continuous filaments can, e.g., be either extruded through another nozzle or fed as yarns supplied by educting with a high efficiency Venturi duct and also delivered as a secondary gas stream.

A secondary gas stream including meltblown fibers can be formed by a second meltblowing apparatus of the type previously described or may be formed by the same meltblowing apparatus used to form the primary gas stream 2.

The primary and secondary streams 2 and 12 are merging with each other, the velocity of the secondary stream 12 preferably being lower than that of the primary stream 2 so that the integrated stream 28 flows in the same direction as primary stream 2. The integrated stream is collected on belt 30 to form coform 32. With reference to forming coform 32, attention is directed to the techniques described in U.S. Pat. No. 4,100,324 previously incorporated herein by reference.

The hydraulic entangling technique involves treatment of the coform 32, while supported on an apertured support 34, with streams of liquid from jet devices 36. The support 34 can be a mesh screen or forming wires or apertured plates. The support 34 can also have a pattern so as to form a nonwoven material with such pattern. Alternatively, the nonwoven material can be formed without a pattern as described in U.S. Pat. No. 3,493,462 to Bunting, et al., the contents of which are incorporated by reference. The apparatus for hydraulic entanglement can be conventional apparatus, such as described in the aforementioned U.S. Pat. No. 3,493,462 to Bunting, et al., or in U.S. Pat. No. 3,485,706 to Evans, the contents of which are incorporated herein by reference. Alternative apparatus is shown in FIG. 1 and described by Honeycomb Systems, Inc., Biddeford, Me., in the article entitled "Rotary Hydraulic Entanglement of Nonwovens", reprinted from *INSIGHT '86 INTERNATIONAL ADVANCED FORMING-/BONDING Conference,* the contents of which are incorporated herein by reference. On such type of an apparatus, fiber entanglement is accomplished by jetting liquid supplied at pressures, e.g., of at least about 100 psi (gauge) to form fine, essentially columnar, liquid streams toward the surface of the supported coform. The supported coform is traversed with the streams until the fibers are randomly entangled and intertwined. The coform can be passed through the hydraulic entangling apparatus a number of times on one or both sides. The liquid can be supplied at pressures of from about 100 to 3000 psi (gauge). The orifices which produce the columnar liquid streams can have typical diameters known in the art, e.g., 0.005 inch, and can be arranged in one or more rows with any number of orifices, e.g., 40, in each row. Various techniques for hydraulic entangling are described in the aforementioned U.S. Pat. No. 3,485,706, and this patent can be referred to in connection with such techniques.

After the coform has been hydraulically entangled, it may, optionally, be treated at bonding station 38 to further enhance its strength. A padder includes an adjustable upper rotatable top roll 40 mounted on a rotatable shaft 42, in light contact, or stopped to provide a 1 or 2 mil gap between the rolls, with a lower pick-up roll 44 mounted on a rotatable shaft 46. The lower pick-up roll 44 is partially immersed in a bath 48 of aqueous resin binder composition 50. The pick-up roll 44 picks up resin and transfers it to the hydraulically entangled coform at the nip between the two rolls 40, 44. Such a bonding station is disclosed in U.S. Pat. No. 4,612,226 to Kennette, et al., the contents of which are incorporated herein by reference. Other optional secondary bonding treatments include thermal bonding, ultrasonic bonding, adhesive bonding, etc. Such secondary bonding treatments provide added strength, but also stiffen the resulting product (that is, provide a product having decreased softness). After the hydraulically entangled coform has passed through bonding station 38, it is dried in through-dryer 52 and wound on winder 54.

The coform of the present invention can also be hydraulically entangled with a reinforcing material (e.g., a reinforcing layer such as a scrim, screen, netting, knit or woven material, of non-elastic or elastic material). Of course, use of a non-elastic reinforcing material may limit the elasticity of the hydraulically entangled web material. A particularly preferable technique is to hydraulically entangle a coform with continuous filaments of a polypropylene spunbond fabric, e.g., a spunbond web composed of fibers with an average denier of 2.3 d.p.f. A lightly point-bonded spunbond can be used; however, for entangling purposes, unbonded spunbond is preferable. The spunbond can be debonded before being provided on the coform. Also, a meltblown/spunbond laminate or a meltblown/spunbond/meltblown laminate as described in U.S. Pat. No. 4,041,203 to Brock, et al. can be provided on the coform web and the assembly hydraulically entangled.

Spunbond polyester webs which have been debonded by passing them through hydraulic entangling equipment can be sandwiched between, e.g., staple coform webs, and entangle bonded. Also, unbonded melt-spun polypropylene and knits can be positioned similarly between coform webs. This technique significantly increases web strength. Webs of meltblown polypropylene fibers can also be positioned between or under coform webs and then entangled. This technique improves barrier properties. Laminates of reinforcing fibers and barrier fibers can add special properties. For example, if such fibers are added as a comingled blend, other properties can be engineered. For example, lower basis weight webs (as compared to conventional loose staple webs) can be produced since meltblown fibers can add needed larger numbers of fibers for the structural integrity necessary for producing low basis weight webs. Such fabrics can be engineered for control of fluid distribution, wetness control, absorbency, printability, filtration, etc. by, e.g., controlling pore size gradients (e.g., in the Z direction). The coform can also be laminated with extruded films (elastic or non-elastic), coatings, foams (e.g., open cell foams), nets, staple fiber webs, etc.

Furthermore, a coform of (1) meltblown fibers and (2) at least one of pulp fibers, staple fibers, other meltblown fibers and continuous filaments can be laminated to various webs, woven or nonwoven, and the laminate hydraulically entangled and, if necessary, mechanically worked to produce elastic web materials within the scope of the present invention. Here again, an important factor to attain the objectives of the present invention is that the coform material and web have sufficient mobility, with sufficient material around which fibrous material can wrap around and within, such that sufficient hydraulic entanglement is achieved. The web can be a foam sheet, or scrim, or a web of a knit or woven or nonwoven material, while still satisfying the objectives of the present invention.

As will be appreciated, additional layers laminated and hydraulically entangled with the coform including the meltblown elastic fibers can provide various attributes to the final product, including reinforcement therefor and a different hand or feel.

It is also advantageous to incorporate a super-absorbent material or other particulate materials, e.g., carbon, alumina, etc., in the coform. A preferable technique with respect to the inclusion of super-absorbent material is to include a material in the coform which can be chemically modified to absorb water after the hydraulic entanglement treatment such as disclosed in U.S. Pat. No. 3,563,241 to Evans, et al. Other techniques for modifying the water solubility and/or absorbency are described in U.S. Pat. Nos. 3,379,720 and 4,128,692 to Reid. The super-absorbent and/or particulate material can be intermingled with the non-elastic meltblown fibers and the fibrous material, e.g., the at least one of pulp fibers, staple fibers, meltblown fibers and continuous filaments at the location where the secondary gas stream of fibrous material is introduced into the primary stream of non-elastic meltblown fibers. Reference is made to U.S. Pat. No. 4,100,324 with respect to incorporating particulate material in the coform. Particulate material can also include synthetic staple pulp material, e.g., ground synthetic staple fibers.

Figure 2A:
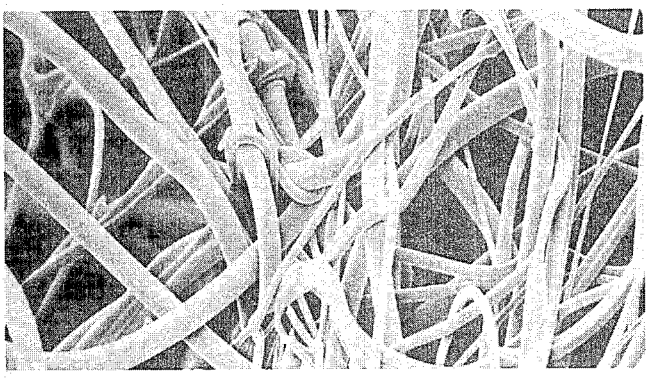
FIGS. 2A and 2B are photomicrographs, (238× and 53× magnification, respectively), of a hydraulically entangled coform of staple fibers and meltblown elastomeric fibers according to the present invention, with FIG. 2B being at a lower magnification than FIG. 2A.
Figure 2B:
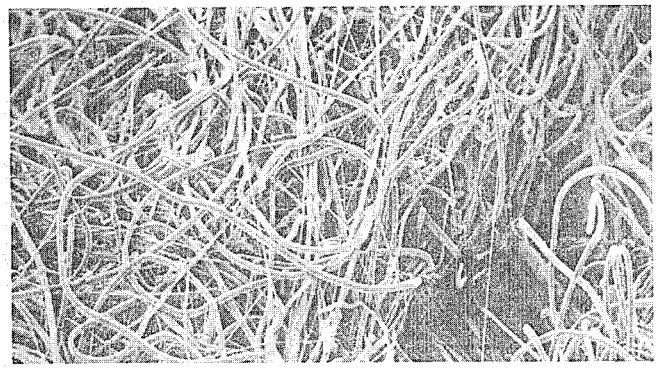

FIGS. 2A and 2B are photomicrographs showing an elastic meltblown and staple fiber coform according to the present invention. In particular, the coform material was 75% meltblown "Estane" 58887 and 25% polyethylene terephthalate staple fibers, the staple fibers having a size of 3.0 dpf×0.6". The coform was hydraulically entangled at a line speed of 23 fpm, on a 100×92 mesh, providing a web having a basis weight of 78 gsm. Both FIGS. 2A and 2B show the treated side.

Figure 3A:
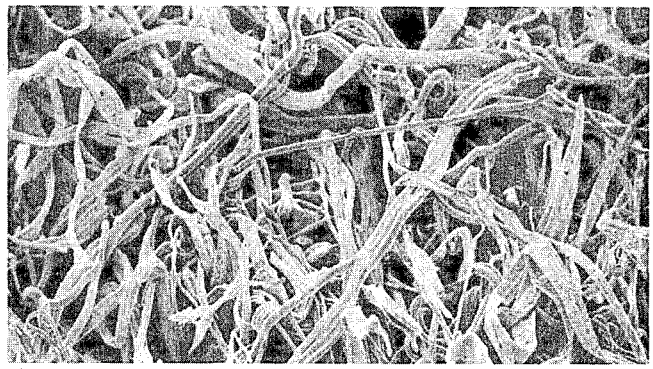
FIGS. 3A and 3B are photomicrographs, (79× and 94× magnification, respectively), of respective opposite sides of a hydraulically entangled coform of pulp and meltblown elastomeric fibers according to the present invention.
Figure 3B:
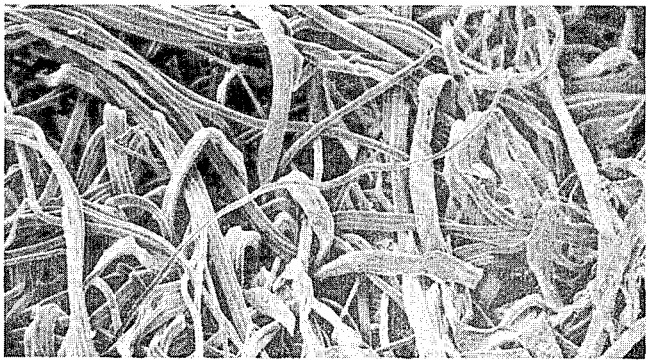

Specific embodiments of the present invention will now be set forth. As can be appreciated, such embodiments are exemplary, and not limiting. Initially, formation of a hydraulically entangled elastic absorbent material will be discussed. A 90 g/m$^2$ pulp elastic coform made with 60% meltblown Q 60/40 blend (that is, a blend 60% "Kraton" G 1657 and 40% polyethylene) and 40% chemically debonded Southern pine wood fiber (IPSS) was hydraulically entangled (with jets of water) utilizing hydraulic entangling equipment as discussed above, using a manifold having jets with 0.005 inch orifices, 40 orifices per inch, and with one row of orifices, with the coform being supported on a 100×92 semi-twill weave mesh belting during the hydraulic entangling treatment. Using a 400 psi (gauge) manifold pressure, the material was entangled by passing it three times under the manifold on each side. The resulting entangled material is shown in FIGS. 3A and 3B.

Subsequent samples were also made at the same time by stacking up to four layers of 90 g/m$^2$ (360 g/m$^2$) on top of one another and then entangling them using more pressure and passes. Such samples were well-bonded together and would not pull apart (e.g., would not delaminate). Patterning of a 90 g/m$^2$ sample was also done by placing a 7×8 mesh on top of the 100×92 mesh belting. The entangled composites had exceptionally good structural integrity, even when repeatedly stretched, the machine direction stretch of the various basis weight samples ranging from 32–66% while machine direction recovery ranged from 92–96%. Stretch and recovery of such materials can readily be changed by adjusting the degree of entanglement, the elastic:cellulose fiber ratio, the type of belting utilized for supporting the coform during the hydraulic entangling, and the degree of pre-stretching of the web before entangling, for example.

Examples of cloth-like elastic staple coforms will now be described. An elastic coform of a 2.3 oz/yd 25/75 blend of meltblown "Estane" 58887 (the fibers being approximately 20$\mu$ in diameter) and polyester staple fibers (3 d.p.f.×0.6") was hydraulically entangled by placing the coform on top of a 7×8 mesh wire which was in turn positioned on top of a 100×92 mesh forming wire. The coform was passed six times under apparatus as shown in FIG. 1, utilizing a manifold having jets with 0.005 inch orifices, 40 orifices per inch, with one row of orifices. The manifold pressure for the first pass was 200 psi (gauge) followed by 400, 800, 1500, 1500 and 1500 psi (gauge). The web was then turned over, aligned to be positioned in the same location as previously on top of the 7×8 wire template and then passed again six times under the manifold at the same respective pressures. With the 7×8 mesh wire, sufficient amounts of fibers were moved to form islands of fibers between the warp and shute wires (that is, staple fibers concentrated in the island areas) such that the islands were simply connected by the bands of melt-blown elastic fibers. The fabric measured 80% stretch and at least 90% recovery, the fabric being isotropic (in both machine and cross directions) in both stretch and recovery properties.

With the use of a wire to position fibers, the weak point of the fabric was the area containing only elastic fibers; to improve strength, elastic fibers could be pre-positioned (such as use of a laminate of positioned melt-blown elastic fibers) to align with the wire template and calendered, and/or subsequent bonding could be utilized in the area of elastic fibers, and/or improved stronger elastomers could be used and/or binders utilized.

As an additional example utilizing staple fibers, melt-blown fibers of a Q 70/30 blend (a blend of 70% "Kraton" G 1657 and 30% polyethylene) and wool fibers have been used to construct elastic staple coform fabrics, which make a semi-disposable wool blanket for possible use in hospitals, backpacking and camping, airlines, etc.

By optimizing fiber sizes, types, blends, web basis weights, process conditions, etc. a wide family of smooth elastic webs with smooth surfaces can be fabricated. Such smooth surfaces of elastic webs, achieved by the elastomeric web material of the present invention is clearly advantageous, as compared to corrugated and rough elastic fabrics previously provided. In this regard, attention is directed to the previously discussed U.S. Pat. No. 4,657,802 to Morman, describing a composite nonwoven elastic web formed by providing a stretched nonwoven elastic web joined to a fibrous nonwoven gatherable web while the elastic web is stretched, whereby, when tension on the elastic web is removed, the elastic web returns to its relaxed length to gather the fibrous nonwoven gatherable web, providing a composite elastic web (that is, a web formed by stretch-bonded-laminate technology). Note also the elastic materials disclosed in U.S. Pat. No. 3,485,706 to Evans, e.g., Example 56 thereof. The composite web formed by the stretch-bonded-laminate technology has a corrugated and rough surface, which is less appealing for use as clothing than the smooth surface of the fabric provided by the present invention.

As can readily be appreciated from the foregoing, elastic absorbents of the present invention will have a variety of uses and advantages in absorbent materials such as diapers, feminine napkins and incontinent articles. In particular, by using high surface energy cellulosic fibers such as wood fibers, rayon, cotton, etc., by adjusting the hydrophobic elastic fiber sizes and amounts, by coating hydrophobic fibers with near-permanent or permanent hydrophilic finishes, and/or by eliminating the use of surfactants, a highly absorbent structure can be made. Moreover, when utilized in disposable incontinence articles or diapers, with such material constituting the absorbent material (which would have elasticity), the absorbent would strategically conform against different body sizes and shapes, which would improve absorbency and also help hold the absorbent to the target load area for effectively containing urine and fecal excretion. Moreover, a loose fitting cloth-like outer cover could be utilized over the absorbent, which would act as a secondary container for more effectively accepting periods of heavy loading demands of urine and for loose stools. Furthermore, utilizing an outer cover in combination with the absorbent material of the present invention, such outer cover could be made breathable and the side of the absorbent facing the outer cover could be designed to be fluid impervious, thereby allowing vapor transmission; such fluid imperviousness could be accomplished by such methods as chemical treatment and/or strategic placement of hydrophobic elastic or polyolefin fibers.

Furthermore, with the elastic incorporated in the absorbent rather than in the outer cover, red markings on the skin would be expected to be less; less elastic force would be applied since only the absorbent, rather than both absorbent and outer cover, would need to be held against the body cavity. Also, the force applied to hold the absorbent would be more evenly distributed over the entire body cavity, and thus skin areas having a high loading (e.g., the hips and the crotch) would be reduced. This would help resolve the perception of the consumer that one was wearing a tight-fitting girdle. Such an elastic absorbent would also reduce the total amount of elastic fiber needed to obtain the desired functional level; and, moreover, less costly thermoplastic elastomers could be utilized because quality and performance levels would not need to be as stringent as compared to incorporating elastics into the outer cover (for example, there would be a need for less stretch, less need for hydrocarbon and halogen resistivity, less need for ultraviolet stability, less need for high aesthetic requirements, etc.).

Furthermore, in view of the good structural integrity and elasticity of the absorbents of the present invention, such absorbents have improved resistance to bunching and wet-compression, which enhance the absorbency and aesthetics. In addition, in view of the entangling phenomenon, wherein high surface energy cellulose fibers can wrap circumferentially around the hydrophobic elastic fibers, thereby masking and reducing the number of hydrophobic sites, fluid capillarity and distribution in the Z-direction is improved. In addition, by utilizing hydraulic entangling, a controlled pore structure can be incorporated into the fibrous web, which can provide desired fluid capillarity and distribution in each of the machine-, cross- and Z-directions.

In order to further improve the absorbency of hydraulically entangled elastic coform materials of the present invention, other types of absorbents, e.g., cellulosic fluff and/or super absorbent materials, can be incorporated in the coform prior to hydraulic entangling, or can be sandwiched between layers of such coform, with the hydraulic entangling then being performed so as to also hold the cellulosic fluff and/or super absorbent material in the web product. As discussed previously, in incorporating super absorbent material, such material can be initially incorporated in the coform in an inactive form, and then activated, by known techniques, after the hydraulic entangling. Alternatively the cellulose fluff and/or super absorbent material can be sandwiched between a coform layer and a layer of another structure (e.g., fibrous web, net, etc.) with which the coform can be hydraulically entangled, with the hydraulic entangling then being performed to provide the absorbent product.

As discussed previously, by adding spunbond filaments to the elastic coform material, prior to hydraulic entanglement, the strength of the entangled product can be further increased (the spunbond filaments act as reinforcement). In order to attain desired elasticity, the spunbond filaments increasing the strength should desirably be of elastomeric material. Alternatively, the spunbond filaments can be made of a material that is elongatable but relatively inelastic, and the web (after hydraulic entanglement) is subjected to a stretching treatment to elongate the spunbond filaments and provide elasticity to the final product. See U.S. Pat. No. 4,209,563 to Sisson.

Various specific examples of the present invention, showing properties of the formed product, are set forth in the following. Of course, such examples are illustrative and are not limited.

In the following examples, the specified materials were hydraulically entangled under the specified conditions. The hydraulic entangling was carried out using hydraulic entangling equipment similar to conventional equipment, having Honeycomb manifolds with 0.005 inch orifices, 40 orifices per inch and with one row of orifices. The percentages of materials in the coforms of these examples are weight percentages.

EXAMPLE 1

| | |
|---|---|
| Coform Materials: | 40% International Paper Super Soft (IPSS)/60% meltblown fibers of Q 70-30 blend (70% "Kraton" G1657 - 30% polyethylene) |
| Entangling Processing | |
| Line Speed: | 23 fpm |
| Entanglement Treatment (psi of each pass);(wire mesh) employed for the coform supporting member): | |
| Side One: 600, 600, 600; 100 × 92 | |
| Side Two: 1200, 1200; 20 × 20 | |

EXAMPLE 2

| | |
|---|---|
| Coform Materials: | 35% polyethylene terephthalate staple fiber/65% meltblown "Arnitel" |
| Entangling Processing | |
| Line Speed: | 40 fpm |
| Entanglement Treatment (psi of each pass); (wire mesh): | |
| Side One: 1500, 1500, 1500; 100 × 92 | |
| Side Two: 1500, 1500, 1500; 100 × 92 | |

EXAMPLE 3

| | |
|---|---|
| Coform Materials: | 35% polyethylene terephthalate staple fiber/65% meltblown "Arnitel" |
| Entangling Processing | |
| Line Speed: | 40 fpm |
| Entanglement Treatment (psi of each pass); (wire mesh): | |
| Side One: 1500, 1500, 1500; 20 × 20 | |
| Side Two: 1500, 1500, 1500; 20 × 20 | |

EXAMPLE 4

| | |
|---|---|
| Coform Materials: | 15% polyethylene terephthalate staple fiber/85% meltblown "Arnitel" |
| Entangling Processing | |
| Line Speed: | 40 fpm |
| Entanglement Treatment (psi of each pass); (wire mesh): | |
| Side One: 100, 1500, 1500, 1500; 100 × 92 | |

-continued

| | |
|---|---|
| Side Two: 1500, 1500, 1500; 100 × 92 | |

EXAMPLE 5

| | |
|---|---|
| Coform Materials: | 40% polyethylene terephthalate staple fiber/60% meltblown "Arnitel" |
| Entangling Processing | |
| Line Speed: | 23 fpm |
| Entanglement Treatment (psi of each pass); (wire mesh): | |
| Side One: 1500, 1500; 1500; 100 × 92 | |
| Side Two: 1500, 1500, 1500; 100 × 92 | |

EXAMPLE 6

| | |
|---|---|
| Coform Materials: | 60% polyethylene terephthalate staple fiber/40% meltblown "Arnitel" |
| Entangling Processing | |
| Line Speed: | 23 fpm |
| Entanglement Treatment (psi of each pass); (wire mesh): | |
| Side One: 600, 900, 1200; 100 × 92 | |
| Side Two: 1500, 1500, 1500; 100 × 92 | |

EXAMPLE 7

| | |
|---|---|
| Coform Materials: | 55% polyethylene terephthalate staple fiber/45% meltblown "Arnitel" |
| Entangling Processing | |
| Line Speed: | 23 fpm |
| Entanglement Treatment (psi of each pass); (wire mesh): | |
| Side One: 500, 500, 500; 20 × 20 | |
| Side Two: 1000, 1000, 1000; 100 × 92 | |

EXAMPLE 8

| | |
|---|---|
| Coform Materials: | a staple fiber/staple elastic coform/staple fiber laminate, of polypropylene staple fiber (approx. 20 g/m$^2$)/coform of 70% wool and 30% "Estane" 58887 (approx. 150 g/m$^2$)/polypropylene staple fiber (approx. 20 g/m$^2$) |
| Entangling Processing | |
| Line Speed: | 23 fpm |
| Entanglement Treatment (psi of each pass); (wire mesh): | |
| Side One: 1200, 1200, 1200; 100 × 92 | |
| Side Two: 1200; 1200, 1200; 100 × 92 | |

EXAMPLE 9

| | |
|---|---|
| Coform Materials: | multiple elastic coform laminate wherein one layer of the laminate is a coform of 40% polyethylene terephthalate staple fiber and 60% "Estane" 58887 (total of approx. 75 g/m$^2$), that was sandwiched between webs of coforms of 60% cotton and 40% "Estane" 58887 (total of approx. 30 g/m$^2$) |
| Entangling Processing | |
| Line Speed: | 23 fpm |
| Entanglement Treatment (psi of each pass); (wire mesh): | |
| Side One: 1500, 1500, 1500; 20 × 20 | |

-continued

| |
|---|
| Side Two: 1500, 1500, 1500; 20 × 20 |

EXAMPLE 10

| | |
|---|---|
| Coform Materials: | multiple elastic coform laminate of a coform of 25% polyethylene terephthalate staple fiber and 75% meltblown "Arnitel" (total of approx. 100 g/m$^2$), sandwiched between webs of a coform of 60% cotton staple fiber and 40% meltblown "Estane" 58887 (total of approx. 30 g/m$^2$) |
| Entangling Processing | |
| Line Speed: | 23 fpm |
| Entanglement Treatment (psi of each pass); (wire mesh): | |
| Side One: 1500, 1500, 1500; 20 × 20 | |
| Side Two: 1500, 1500, 1500; 20 × 20 | |

Physical properties of the materials of Examples 1 through 10 were measured in the following manner:

The bulk was measured using a bulk or thickness tester available in the art. The bulk was measured to the nearest 0.001 inch.

The MD and CD grab tensiles were measured in accordance with Federal Test Method Standard No. 191A (Methods 5041 and 5100, respectively).

The abrasion resistance was measured by the rotary platform, double-head (Tabor) method in accordance with Federal Test Method Standard No. 191A (Method 5306). Two type CS10 wheels (rubber based and of medium coarseness) were used and loaded with 500 grams. This test measured the number of cycles required to wear a hole in each material. The specimen is subjected to rotary rubbing action under controlled conditions of pressure and abrasive action.

The absorbency rate of the samples was measured on the basis of the number of seconds to completely wet out each sample in a constant temperature water bath and oil bath.

A "cup crush" test was conducted to determine the softness, i.e., hand and drape, of each of the samples. The lower the peak load of a sample in this test, the softer, or more flexible, the sample. Values of 100 to 150 grams, or lower, correspond to what is considered a "soft" material.

The elongation and recovery tests were conducted as follows. Three inch wide by four inch long samples were stretched in four inch Instrom jaws to the elongation length, described as % Elongation. For example, a four inch length stretched to a 5⅝" length would be elongated 40.6%. The initial load (lbs.) was recorded, then after 3 minutes was recorded before relaxing the sample. Thereafter, the length was measured, and initial percent recovery determined. This is recorded as initial percent recovery. For example, if a material was stretched to 4½" (12.5% Elongation) and then after relaxation measured 4-1/16", the sample recovery was 87.5%. After thirty (30) minutes, the length was again measured and a determination made (and recorded) as percent recovery after thirty (30) minutes. This elongation test is not a measure of the elastic limit, the elongation being chosen within the elastic limit.

The results of these tests are shown in Table 1. In this Table, for comparative purposes, are set forth physical properties of two known hydraulically entangled nonwoven fibrous materials, "Sontara" 8005, a spunlaced fabric of 100% polyethylene terephthalate staple fibers (1.35 d.p.f.×¾") from E. I. DuPont De Nemours and Company, and "Optima", a converted product of 55% red cedar pulp fibers and 45% polyethylene terephthalate staple fibers from American Hospital Supply Corp.

TABLE 1

| | | | MD Grab Tensiles | | | | |
|---|---|---|---|---|---|---|---|
| Example | Basis Wt. (gsm) | Bulk (in) | Peak Energy (in-lb) | Peak Load (lb) | Peak Elongation (in) | Peak Strain (%) | Fail Energy (in-lb) |
| 1 | 240 | .060 | 9.9 | 4.2 | 3.1 | 102.8 | 19.4 |
| 2 | 176 | .031 | 52.6 | 38.6 | 2.9 | 95.0 | 110.4 |
| 3 | 184 | .038 | 65.6 | 41.8 | 3.4 | 112.6 | 131.2 |
| 4 | 96 | .023 | 25.0 | 28.8 | 2.2 | 74.8 | 75.6 |
| 5 | 133 | .033 | 31.0 | 32.5 | 2.5 | 82.7 | 77.7 |
| 6 | 103 | .030 | 30.9 | 29.3 | 2.6 | 85.7 | 79.4 |
| 7 | 55 | .030 | 17.0 | 7.4 | 4.0 | 132.5 | 32.2 |
| 8 | 125 | .071 | 16.7 | 6.3 | 3.7 | 123.2 | 31.3 |
| 9 | 135 | .047 | 29.2 | 21.3 | 2.9 | 97.1 | 73.5 |
| 10 | 166 | .053 | 42.5 | 33.4 | 2.9 | 97.9 | 93.1 |
| Sontara ® 8005 | 65 | 0.020 | 20.1 | 42.3 | 1.0 | 34.6 | 40.4 |
| Optima ® | 72 | 0.020 | 12.9 | 26.3 | 1.0 | 33.8 | 35.1 |

| | CD Grab Tensiles | | | | | Tabor Abrasion of Resistance (no. of cycles) | |
|---|---|---|---|---|---|---|---|
| Example | Peak Energy (in-lb) | Peak Load (lb) | Peak Elongation (in) | Peak Strain (%) | Fail Energy (in-lb) | Side 1 | Side 2 |
| 1 | 8.3 | 2.9 | 3.9 | 131.4 | 14.4 | 30 | 12 |
| 2 | 60.7 | 29.4 | 4.5 | 151.3 | 99.4 | 100+ | 100+ |
| 3 | 40.5 | 29.7 | 3.8 | 126.6 | 91.1 | 100+ | 100+ |
| 4 | 25.8 | 15.8 | 3.8 | 127.5 | 49.4 | 100+ | 100+ |
| 5 | 35.2 | 33.2 | 2.7 | 91.1 | 79.9 | 100+ | 100+ |
| 6 | 28.3 | 26.5 | 2.9 | 98.4 | 61.3 | 100+ | 100+ |
| 7 | 11.7 | 5.7 | 4.5 | 151.3 | 21.4 | 100+ | 100+ |
| 8 | 16.1 | 6.3 | 5.2 | 171.9 | 32.1 | 100+ | 100+ |
| 9 | 36.9 | 21.8 | 3.8 | 125.4 | 85.8 | 100+ | 100+ |
| 10 | 52.2 | 37 | 3.3 | 109.5 | 107.3 | 100+ | 100+ |
| Sontara ® 8005 | 23.0 | 18.5 | 4.0 | 134.3 | 39.8 | 28 | 20 |
| Optima ® | 16.6 | 22.1 | 2.1 | 71.0 | 32.0 | 93 | 24 |

MD Elongation and Recovery

TABLE 1-continued

| Example | Absorbency Water Sink (sec) | Absorbency Oil Sink (sec) | Elongation (%) | Initial Load lbs | 3 Min. Load lbs | Initial Percent Recovery | Percent Recovery After 30 Mins. |
|---|---|---|---|---|---|---|---|
| 1 | 60+/1.3* | 1.8 | 41 | 2.9 | 1.6 | 79 | 94 |
| 2 | | | 14 | 8.4 | 5.9 | 97 | 99 |
| 3 | | | 17 | 6.0 | 4.3 | 95 | 95 |
| 4 | | | 16 | 6.4 | 4.3 | 95 | 95 |
| 5 | | | 13 | 5.1 | 3.3 | 94 | 99 |
| 6 | | | 44 | 9.9 | 5.9 | 83 | 92 |
| 7 | | | 28 | 2.1 | 1.3 | 89 | 89 |
| 8 | | | 22 | 3.9 | 1.8 | 90 | 93 |
| 9 | | | 16 | 2.2 | 1.2 | 92 | 92 |
| 10 | | | 19 | 6.0 | 3.9 | 92 | 93 |

| Example | CD Elongation and Recovery: Elongation (%) | Initial Load lbs | 3 Min. Load lbs | Initial Percent Recovery | Percent Recovery After 30 Mins. | Cup Crush (softness): Peak Load (grams) | Total Energy (grams/mm) |
|---|---|---|---|---|---|---|---|
| 1 | 28 | 2.3 | 1.3 | 86 | 89 | | |
| 2 | 20 | 3.7 | 2.7 | 94 | 95 | 285 | 6083 |
| 3 | 19 | 3.0 | 2.3 | 96 | 96 | 285 | 5929 |
| 4 | 50 | 6.5 | 4.2 | 77 | 84 | 128 | 2177 |
| 5 | 13 | 4.5 | 2.9 | 94 | 95 | 275 | 5820 |
| 6 | 31 | 7.0 | 4.2 | 81 | 90 | 252 | 4940 |
| 7 | 33 | 1.7 | 1.1 | 84 | 84 | 48 | 748 |
| 8 | 47 | 1.9 | 1.1 | 80 | 97 | | |
| 9 | 22 | 4.6 | 2.4 | 89 | 89 | 275 | 4160 |
| 10 | 16 | 4.6 | 3.1 | 93 | 93 | | |
| Sontara ® 8005 | | | | | | 89 | 1537 |
| Optima ® | | | | | | 196 | 3522 |

*surfactant treated with Triton X-102, by Rohm & Haas Corp.

As can be seen in the foregoing Table 1, nonwoven fibrous elastic coform material within the scope of the present invention has a superior combination of properties of strength, abrasion resistance and softness. In particular, it is noted that use of elastic meltblown material provides outstanding abrasion resistance, which is attributed in part to the increased ability of the elastic meltblown fibers to hold the other material therewith. In addition, the relatively large coefficient of friction of meltblown elastic fibers add abrasion resistance to the web. The present invention can be used to provide durable goods with good pilling resistance. Furthermore, the material of the present invention has elastic recovery, which is one of the great deficiencies of conventional hydraulically entangled nonwoven webs. Moreover, the present invention can provide webs having good stretch and recovery, but without a rubbery feeling. Also, because of the good elastic properties and drape, the webs according to the present invention feel alive. Furthermore, due to the hydraulic entangling a terry-cloth effect can be achieved.

In addition, by modifying the amount of staple fiber used, the "feel" of the formed product can be desirably controlled; and, e.g., controlled to avoid a "rubbery" feel. For example, by using 60% staple polyethylene terephthalate fibers with meltblown "Arnitel", a rubbery feel is avoided.

Also, by the present invention the stretch properties of the formed web can be controlled, by choice of the backing used for hydraulic entanglement. For example, use of a more open mesh backing e.g., 20×20 rather than 100×92) provided a web with increased stretch.

This case is one of a group of cases which are being filed on the same date. The group includes (1) "Nonwoven Fibrous Hydraulically Entangled Elastic Coform Material and Method of Formation Thereof", L. Trimble, et al. (KC Serial No. 7982); (2) "Nonwoven Fibrous Hydraulically Entangled Non-Elastic Coform Material and Method of Formation Thereof", F. Radwanski, et al. (KC Serial No. 7977); (3) "Hydraulically Entangled Nonwoven Elastomeric Web and Method of Forming the Same", F. Radwanski, et al. (KC Serial No. 7975); (4) "Nonwoven Hydraulically Entangled Non-Elastic Web and Method of Formation Thereof", F. Radwanski, et al. (KC Serial No. 7974); and (5) "Nonwoven Material Subjected to Hydraulic Jet Treatment in Spots, and Method and Apparatus for Producing the Same", F. Radwanski (KC Serial No. 8030). The contents of the other applications in this group, other than the present application, are incorporated herein by reference.

While we have shown and described several embodiments in accordance with the present invention, it is understood that the same is not limited thereto, but is susceptible of numerous changes and modifications as are known to one having ordinary skill in the art, and we therefor do not wish to be limited to the details shown and described herein, but intend to cover all such modifications as are encompassed by the scope of the appended claims.

What is claimed is:

1. A nonwoven fibrous elastomeric web material comprising a hydraulically entangled admixture of (1) a first component of meltblown fibers and (2) a second component of at least one of pulp fibers, staple fibers, meltblown fibers and continuous filaments, at least one of the first component and the second component being elastic, said admixture having been subjected to high pressure liquid jets causing entanglement and intertwining of said first component and said second component so as to form an elastomeric web material.

2. A nonwoven fibrous elastomeric web material according to claim 1, wherein said second component includes pulp fibers, whereby an absorbent web material is formed.

3. A nonwoven fibrous elastomeric web material according to claim 2, wherein said pulp fibers include cellulosic pulp fibers.

4. A nonwoven fibrous elastomeric web material according to claim 3, wherein said second component is selected from the group consisting of wood fibers, rayon fibers and cotton fibers.

5. A nonwoven fibrous elastomeric web material according to claim 1, wherein the web material is an absorbent of a disposable diaper.

6. A nonwoven fibrous elastomeric web material according to claim 2, wherein the admixture subjected to hydraulic entangling has particulate material incorporated therein.

7. A nonwoven fibrous elastomeric web material according to claim 6, wherein the particulate material is particles of super absorbent materials.

8. A nonwoven fibrous elastomeric web material according to claim 1, wherein said elastomeric web material is a web material formed by subjecting a laminate of a layer of said admixture and at least one other layer to hydraulic entangling.

9. A nonwoven fibrous elastomeric web material according to claim 8, wherein said at least one other layer is a nonwoven fibrous layer.

10. A nonwoven fibrous elastomeric web material according to claim 9, wherein, at the time of the hydraulic entangling, a layer of particulate material is positioned between said layer of said admixture and said at least one other layer.

11. A nonwoven fibrous elastomeric web material according to claim 1, wherein said elastomeric web material has a smooth surface.

12. A nonwoven fibrous elastomeric web material according to claim 1, wherein said admixture consists essentially of meltblown elastomeric fibers as the first component and said pulp.

13. A nonwoven fibrous elastomeric web material according to claim 1, wherein said admixture consists essentially of meltblown elastomeric fibers as the first component and said staple fibers.

14. A nonwoven fibrous elastomeric web material according to claim 13, wherein said staple fibers are synthetic staple fibers.

15. A nonwoven fibrous elastomeric web material according to claim 13, wherein said staple fibers are natural staple fibers.

16. A nonwoven fibrous elastomeric web material according to claim 1, wherein said admixture is an admixture formed by extruding material, for forming the first component through a meltblowing die, and intermingling said second component with the extruded material, and then codepositing the intermingled first component and second component on a collecting surface so as to form said admixture.

17. A nonwoven fibrous elastomeric web material according to claim 1, wherein the admixture includes a reinforcing material.

18. A nonwoven fibrous elastomeric web material according to claim 1, wherein the meltblown fibers of the first component are elastic meltblown fibers.

19. A nonwoven fibrous elastomeric web material according to claim 1, wherein said elastomeric web material has isotropic stretch and recovery, in both machine- and cross-directions.

20. A process for forming a nonwoven fibrous elastomeric web material, comprising providing an admixture including (1) a first component of meltblown fibers and (2) a second component of at least one material selected from the group consisting of pulp fibers, staple fibers, meltblown fibers and continuous filaments, with at least one of the first and second components being elastic, on a support; and jetting a plurality of high-pressure liquid streams toward at least one surface of said admixture, so as to hydraulically entangle and intertwine said first component and said second component to thereby form an elastomeric material.

21. A process according to claim 20, wherein at least one of said admixture on a support and plurality of high-pressure liquid streams are moved relative to one another so that said plurality of high-pressure liquid streams traverses the length of said admixture on said support.

22. A process according to claim 21, wherein said plurality of high-pressure liquid streams traverses said admixture on said support a plurality of times.

23. A process according to claim 20, wherein the admixture has opposed major surfaces, and said plurality of high-pressure liquid streams are jetted toward each of the opposed major surfaces of said admixture.

24. A process according to claim 20, wherein the admixture has been provided by extruding material of the first component through a meltblowing die, intermingling said second component with the extruded material, and then codepositing the first component and the second component on a collecting surface so as to form the admixture.

25. A process according to claim 24, wherein the second component is intermingled with the extruded material just downstream of the meltblowing die.

26. A process according to claim 20, wherein the meltblown fibers of the first component are elastic meltblown fibers.

27. Product formed by the process of claim 20.

* * * * *